US011350745B2

(12) United States Patent
Rehage et al.

(10) Patent No.: US 11,350,745 B2
(45) Date of Patent: Jun. 7, 2022

(54) STORAGE SHELF BASE FOR A PIECE OF FURNITURE OR HOUSEHOLD APPLIANCE

(71) Applicant: Paul Hettich GmbH & Co. KG, Kirchlengern (DE)

(72) Inventors: Daniel Rehage, Muenster (DE); Andreas Matthes, Chemnitz (DE); Bernd Lehmann, Chemnitz (DE); Mathias Winkler, Chemnitz (DE); Norbert Virgin, Chemnitz (DE); Ulrich Siegert, Limbach-Oberfrohna (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 0 days.

(21) Appl. No.: 17/256,740

(22) PCT Filed: May 16, 2019

(86) PCT No.: PCT/EP2019/062724
§ 371 (c)(1),
(2) Date: Dec. 29, 2020

(87) PCT Pub. No.: WO2020/007525
PCT Pub. Date: Jan. 9, 2020

(65) Prior Publication Data

US 2021/0227974 A1 Jul. 29, 2021

(30) Foreign Application Priority Data

Jul. 4, 2018 (DE) ..... 10 2018 116 210.3

(51) Int. Cl.
*A47B 91/06* (2006.01)
*F25D 11/00* (2006.01)

(52) U.S. Cl.
CPC ..... *A47B 91/06* (2013.01); *F25D 11/00* (2013.01)

(58) Field of Classification Search
CPC combination set(s) only.
See application file for complete search history.

(56) References Cited

U.S. PATENT DOCUMENTS 2,316,408 A * 4/1943 Dawson ..... F16H 25/14 74/55
2,647,812 A 8/1953 Saunders
4,124,262 A * 11/1978 Schill ..... A47B 49/004 16/378

(Continued)

FOREIGN PATENT DOCUMENTS

CN 102261804 A 11/2011
DE 619101 C 9/1935

(Continued)

OTHER PUBLICATIONS

International Search Report dated Jul. 8, 2019 issued in PCT/EP2019/062724.

(Continued)

*Primary Examiner* — Monica E Millner
(74) *Attorney, Agent, or Firm* — Collard & Roe, P.C.

(57) ABSTRACT

A storage shelf base for an item of furniture or household appliance has a support plate stationarily arranged on a body of the item of furniture or household appliance, and a storage shelf which is positively driven relative to the support plate and can simultaneously be moved rotationally and translationally. Facing bearing surfaces of the support plate and the storage shelf have respective at least substantially closed circulating running grooves, in which rolling elements are guided. The support plate can be detachably secured to the body of the item of furniture or household appliance. At least one securing region for detachably securing the support plate to the body of the item of furniture or household appliance is formed on the support plate and the storage shelf can be secured to the support plate without the use of tools.

19 Claims, 11 Drawing Sheets

(56) References Cited

U.S. PATENT DOCUMENTS

Figure 1:
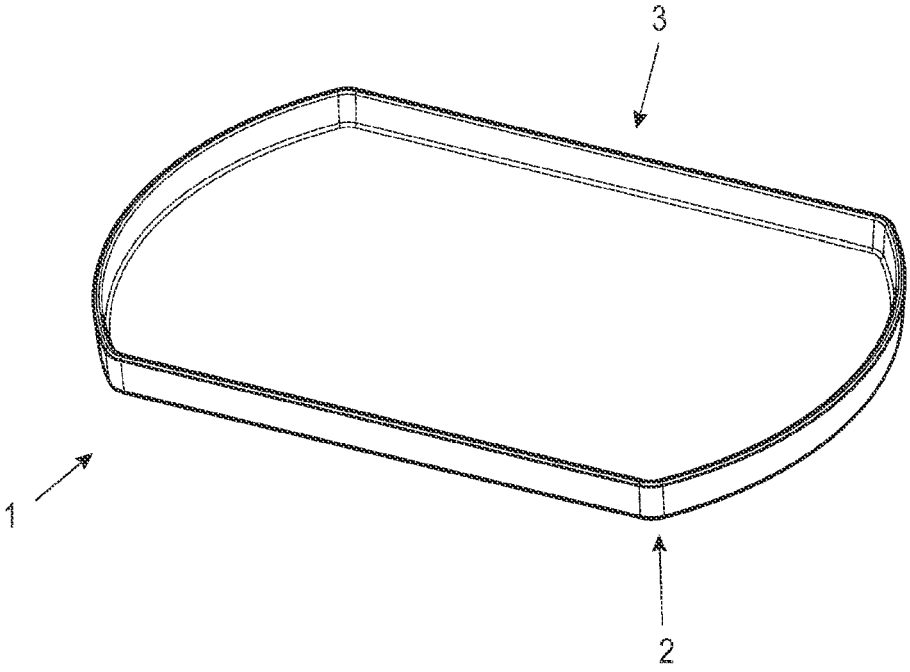

| | | | | |
|---|---|---|---|---|
| 4,191,437 | A * | 3/1980 | Funke | A47B 49/00 108/94 |
| 4,392,628 | A | 7/1983 | Hadfield et al. | |
| 4,485,997 | A * | 12/1984 | Potter | A47B 49/00 211/163 |
| 5,249,856 | A | 10/1993 | Dreier | |
| 6,585,119 | B2 * | 7/2003 | Palder | A47F 5/02 211/163 |
| 9,022,495 | B1 * | 5/2015 | Conner, Sr. | F25D 25/027 312/408 |
| 9,052,134 | B1 * | 6/2015 | Batchler | F25D 25/02 |
| 9,528,753 | B1 * | 12/2016 | Conner, Sr. | A47F 3/08 |
| 2002/0117943 | A1 | 8/2002 | Gerkey et al. | |
| 2010/0176074 | A1 * | 7/2010 | Andersen | A47F 5/0087 211/59.2 |
| 2017/0184335 | A1 * | 6/2017 | Jeon | F25D 23/025 |
| 2020/0018349 | A1 | 1/2020 | Rehage et al. | |

FOREIGN PATENT DOCUMENTS

| | | | |
|---|---|---|---|
| DE | 1198026 | B | 8/1965 |
| DE | 4216765 | A1 | 12/1992 |
| DE | 102017106170 | A1 | 9/2018 |
| EP | 0447846 | A2 | 9/1991 |
| WO | 03060403 | A1 | 7/2003 |

OTHER PUBLICATIONS

German Search Report dated Mar. 13, 2019 issued in the corresponding German Application Serial No. 10 2018 116 210.3 (with English translation of relevant parts).

* cited by examiner

STORAGE SHELF BASE FOR A PIECE OF FURNITURE OR HOUSEHOLD APPLIANCE

CROSS REFERENCE TO RELATED APPLICATIONS

This application is the National Stage of PCT/EP2019/062724 filed on May 16, 2019, which claims priority under 35 U.S.C. § 119 of German Application No. 10 2018 116 210.3 filed on Jul. 4, 2018, the disclosures of which are incorporated by reference. The international application under PCT article 21(2) was not published in English.

BACKGROUND OF THE INVENTION

The present invention relates to a storage shelf base for a piece of furniture or household appliance according to the preamble of Claim 1. The invention furthermore relates to a piece of furniture or household appliance having such a storage shelf base.

Storage shelf bases of the type in question essentially consist of a support plate and a simultaneously rotationally and translationally movable storage shelf guided thereon, wherein the simultaneous rotational and translational mobility permits accessibility to areas otherwise difficult to reach in a storage space of a piece of furniture or also household appliance, for example, an office, kitchen, refrigerator, or freezer cabinet.

Thus, a storage shelf base equipped with a turntable is known from DE 42 16 765 A1, in which the turntable is installed directly into the base plate of the storage shelf base.

A simultaneously rotationally and translationally movable storage shelf positively guided in relation to the support plate is known from DE 10 2017 106 170 A1.

These storage shelf bases known from the prior art have the disadvantage, on the one hand, of the relatively complex installation of such a storage shelf base.

In addition, due to the relatively complex installation, cleaning of the storage shelf base is only possible in the installed state, so that portions of the storage shelf base can only be cleaned after prior removal of the entire storage shelf base.

SUMMARY OF THE INVENTION

The object of the present invention is to provide a storage shelf base which can be installed in, removed from, and cleaned in a simpler manner in the body of a piece of furniture or household appliance.

This object is achieved by a storage shelf base for pieces of furniture or household appliances having the features of Claim 1.

The stated object is furthermore also achieved by a piece of furniture having the features of Claim 17 and a household appliance having the features of Claim 18. In addition, a method for installing a storage shelf base is described in Claim 19.

The storage shelf base according to the invention has a support plate arranged in a stationary manner on a body of the piece of furniture or household appliance and a simultaneously rotationally and translationally movable storage shelf positively guided in relation to the support plate.

Bearing surfaces of the support plate and the storage shelf facing toward one another each have at least predominantly closed circumferential running grooves, in which roller bodies are guided. The support plate can be fastened removably on the body of the piece of furniture or household appliance.

At least one fastening region for the removable fixing of the support plate on the body of the piece of furniture or household appliance is formed on the support plate. The storage shelf is fixable on the support plate without tools in this case.

A storage shelf designed in this manner can be assembled easily and installed on the body of a piece of furniture or household appliance.

Due to the fixing of the storage shelf on the support plate without tools thus enabled, easy cleaning and removal of the storage shelf base are also enabled.

In addition, the storage shelf base can be manufactured and transported cost-effectively in relation to storage shelves known from the prior art by dispensing with prior installation at the factory.

Advantageous embodiment variants of the invention are the subject matter of the dependent claims.

According to one advantageous embodiment variant of the invention, the running grooves are integrated into the bearing surfaces of the support plate and the storage shelf. A low structural height of the storage shelf base is thus enabled.

According to an alternative, also advantageous embodiment variant of the invention, the running grooves are fastened on the bearing surfaces of the support plate and the storage shelf, in particular materially bonded or screwed on.

The support plate and the storage shelf are thus significantly simpler to manufacture, since running grooves are not formed on here and openings for the guide channel and the studs do not have to be introduced into the support plate or the storage shelf, respectively.

According to one advantageous embodiment variant of the invention, a stud protruding into a guide channel of the support plate is arranged on the bearing surface of the storage shelf. The stud can advantageously have a mushroom-shaped head in this case.

This enables simple and reliable guiding of the storage shelf in relation to the support plate for the translational movement.

According to a further advantageous embodiment variant, the guide channel has an undercut, behind which a cam of the stud engages in the installed state of the storage shelf on the support plate. In this case, the undercut can be formed over the entire region of the guide channel.

The undercut is advantageously only formed in the region of the guide channel which engages with the stud during a movement of the storage shelf.

In the starting position, the storage shelf can thus be removed from the support plate without great application of force, and the storage shelf is secured on the support plate during the movement.

Vertical fixing of the storage shelf on the support plate is thus ensured in a simple manner.

For facilitated tool-free installation of the support plate on the storage shelf, according to one preferred embodiment variant, the guide channel has an installation region having at least one catch element, into which the stud is insertable.

To prevent the storage shelf from inadvertently sliding or pivoting out in relation to the support plate from a starting position, a taper is provided at one end of the guide channel, using which the stud can be held in a position in which the storage shelf is positioned in a starting position in relation to the support plate.

This taper is preferably formed by the free ends of catch elements arranged opposing one another.

The catch elements thus fulfill two different tasks, namely, firstly, the removable fixing of the stud in the guide channel in the vertical direction and, secondly, the above-claimed prior fixing of the stud in the position holding the storage shelf in its starting position.

According to a further advantageous embodiment variant, the guide channel is formed as a separate component which is installable in a recess of the support plate adapted to the outer contour of the guide channel.

The guide channel preferably has at least one catch lug on its outer circumference, which is lockable in a catch recess of the recess of the support plate, so that the guide channel is insertable and lockable in a simple manner in the recess in the support plate.

According to a further preferred embodiment variant, the outer circumference of the guide channel is formed asymmetrically and is provided with a positioning piece, so that during the installation, the taper of the guide channel is exclusively insertable in the predetermined position into the support plate.

According to one embodiment variant, the storage shelf base additionally has a roller body cage for holding the roller bodies and the support plate has at least one positioning element for correct positioning of the ball cage.

According to a further embodiment variant, the fastening region of the support plate has at least one receptacle for holding a fastening element.

According to one preferred embodiment variant, the fastening element is designed here as a suction cup, wherein the receptacle is designed as a suction cup receptacle for holding the suction cup.

This embodiment variant is suitable in particular for use in refrigerators having glass bottom panels, on which such suction cups ensure a good hold.

According to an alternative embodiment variant, at least one of the receptacles is designed as a bolt receptacle for guiding through a fastening element designed as a threaded bolt.

This embodiment variant is suitable in particular for use in pieces of furniture having wood or plastic bottom panels.

According to still a further alternative embodiment variant, the fastening region has at least one adhesive surface, on which an adhesive element is attachable for fixing the support plate on a bottom panel of the piece of furniture or household appliance.

For example, double-sided adhesive tape comes into consideration as an adhesive element here.

The item of furniture according to the invention is distinguished by a storage shelf base as described above.

The household appliance according to the invention is also distinguished by a storage shelf base as described above.

The method according to the invention for installing a storage shelf base has the following steps:

a. attaching a support plate to a body of the piece of furniture or household appliance by means of one of the above-mentioned detachable fastening elements;

b. placing a roller body cage having roller bodies mounted therein on the support plate;

c. placing a storage shelf having a bearing surface on the roller body cage, wherein a stud protruding from the bearing surface of the storage shelf is inserted into the guide channel.

Optionally, an insertion of a guide channel into a recess of the support plate also takes place as step al after step a if the guide channel is embodied as a separate component.

In this case, step al can already be performed at the factory, so that this step is omitted during the installation of the storage shelf on location at the final customer.

The guide channel can also be integrally formed on the support plate.

Preferred exemplary embodiments of the invention are explained in greater detail hereinafter on the basis of the appended drawings. In the figures:

BRIEF DESCRIPTION OF THE DRAWING FIGURES

Figure 3:
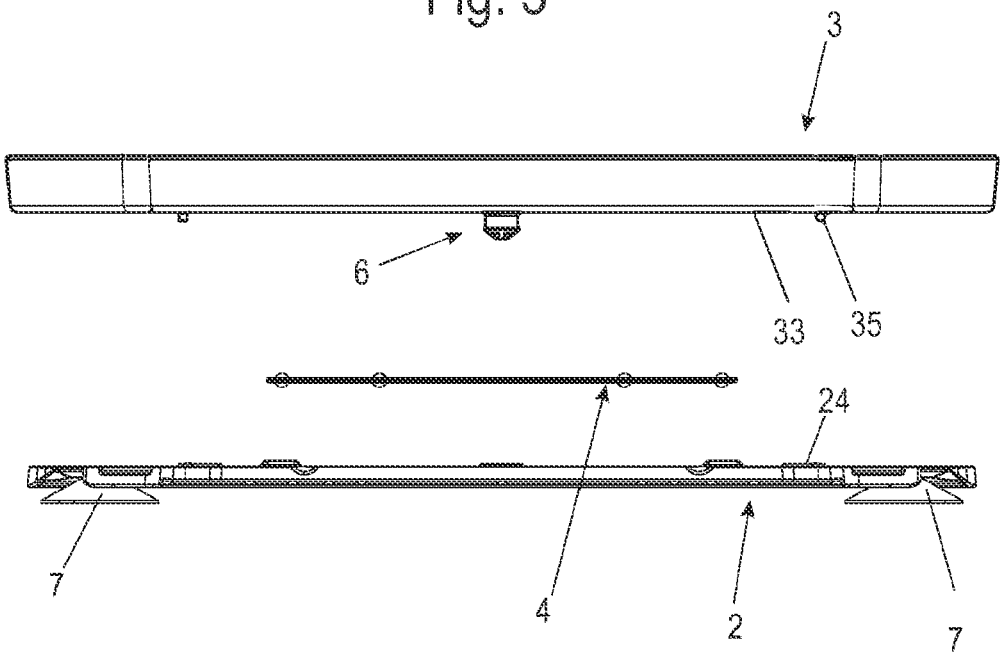
Figure 2:
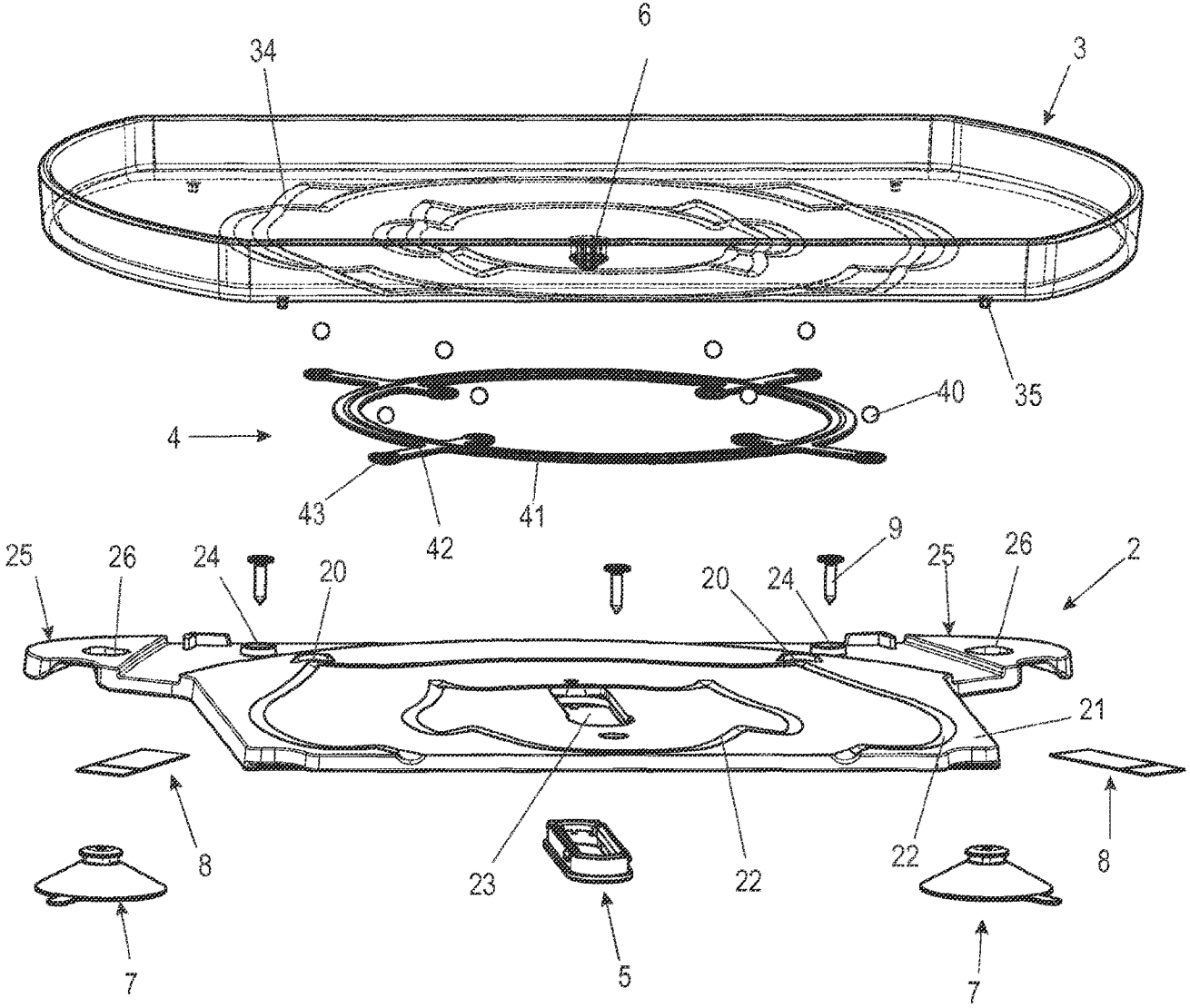
Figure 4:
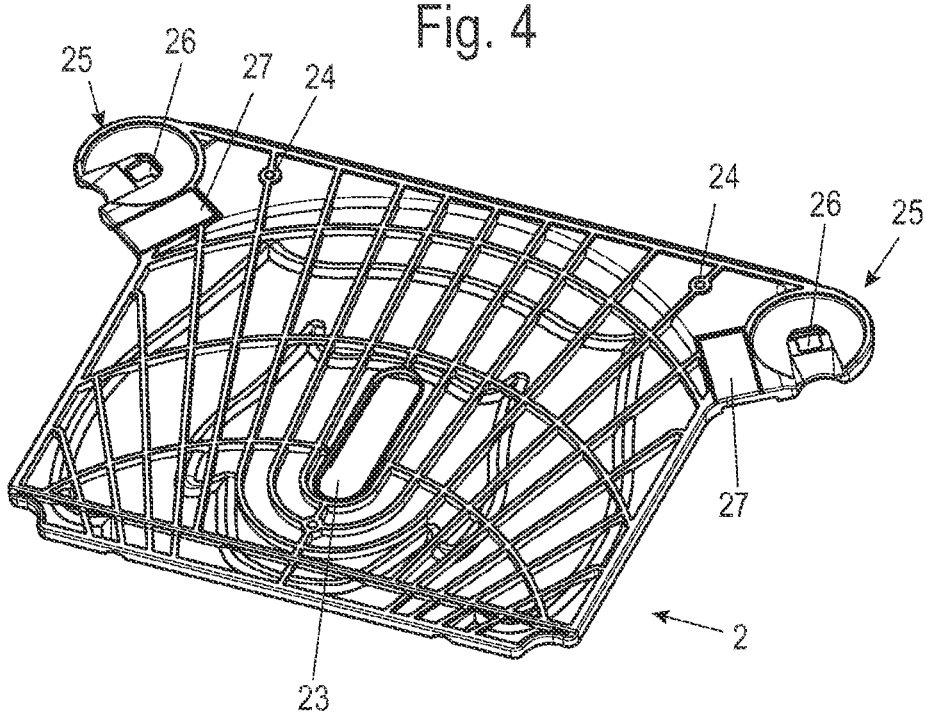
Figure 5:
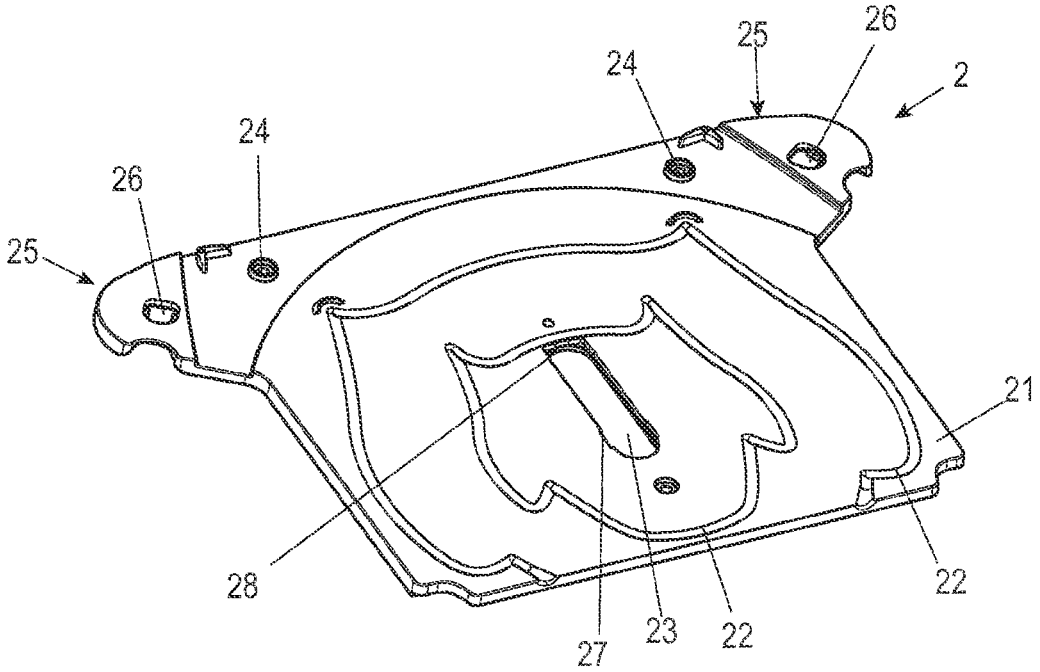
Figure 6:
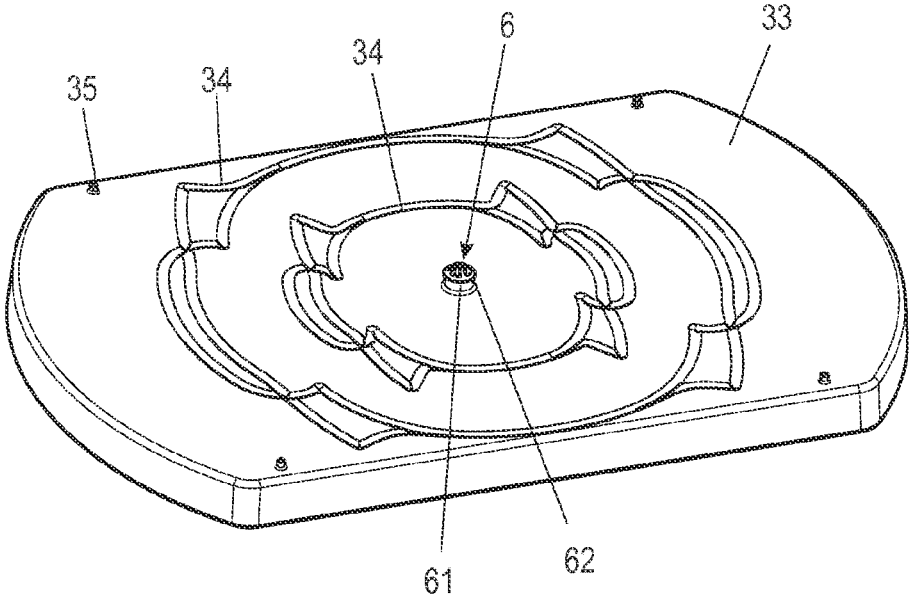
Figure 7:
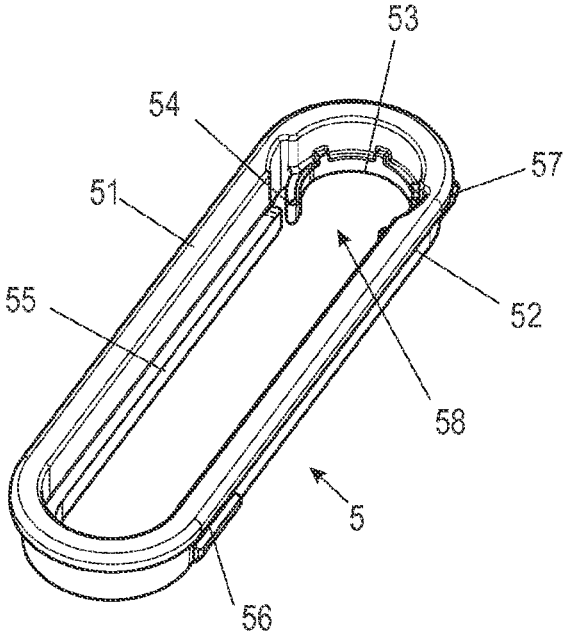
Figure 8:
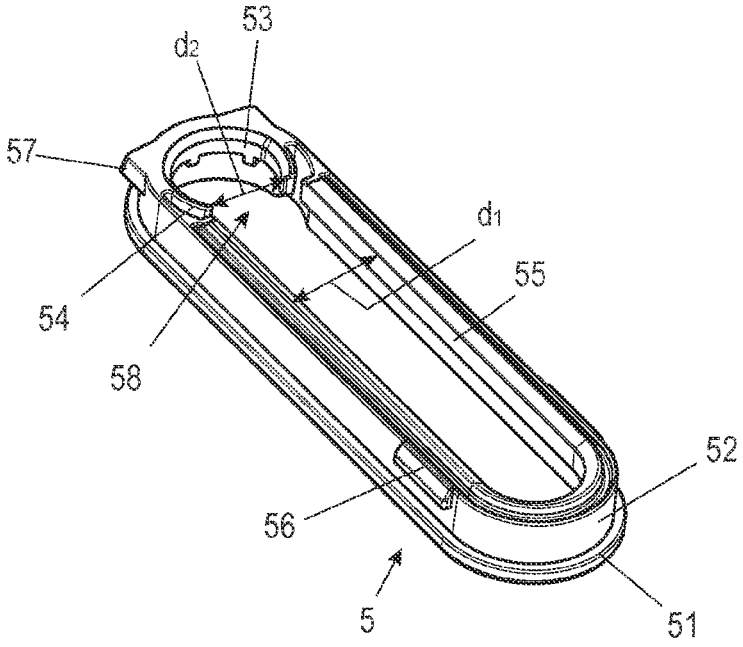
Figure 9:
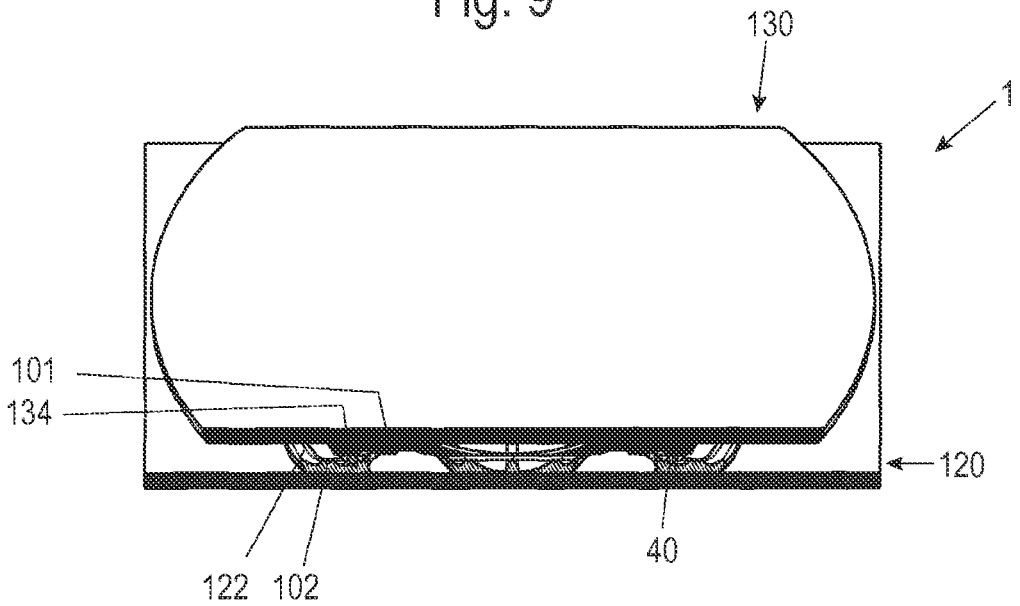
Figure 10:
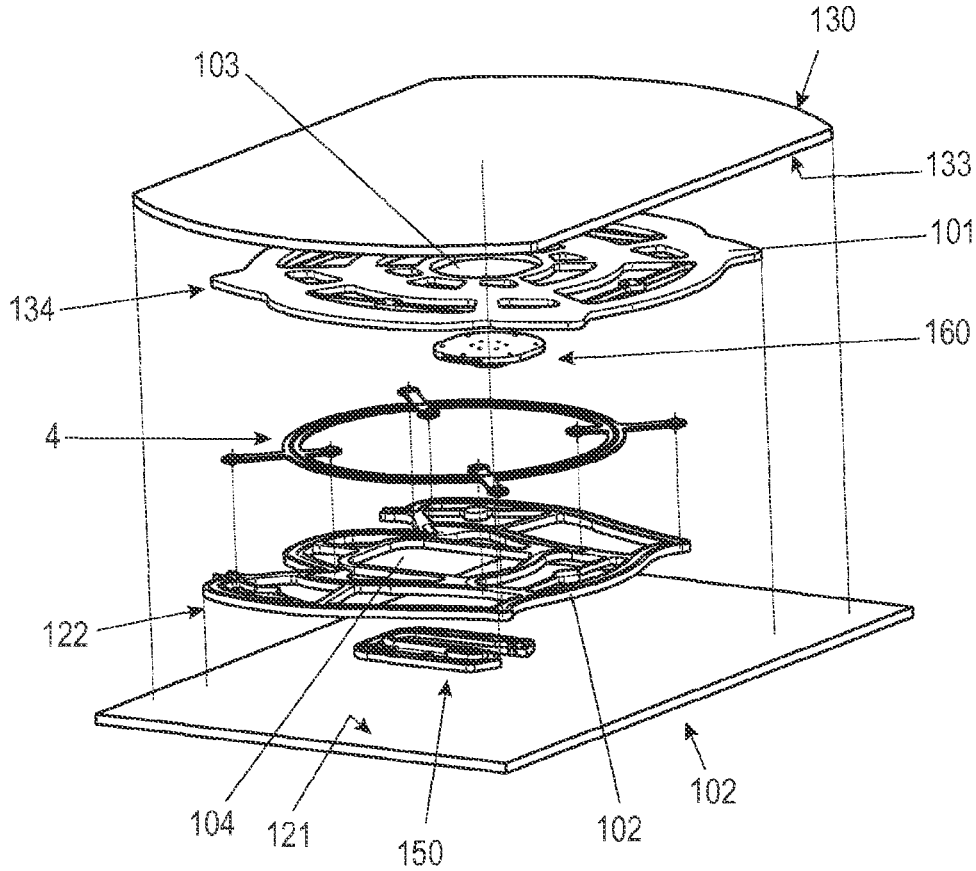
Figure 11:
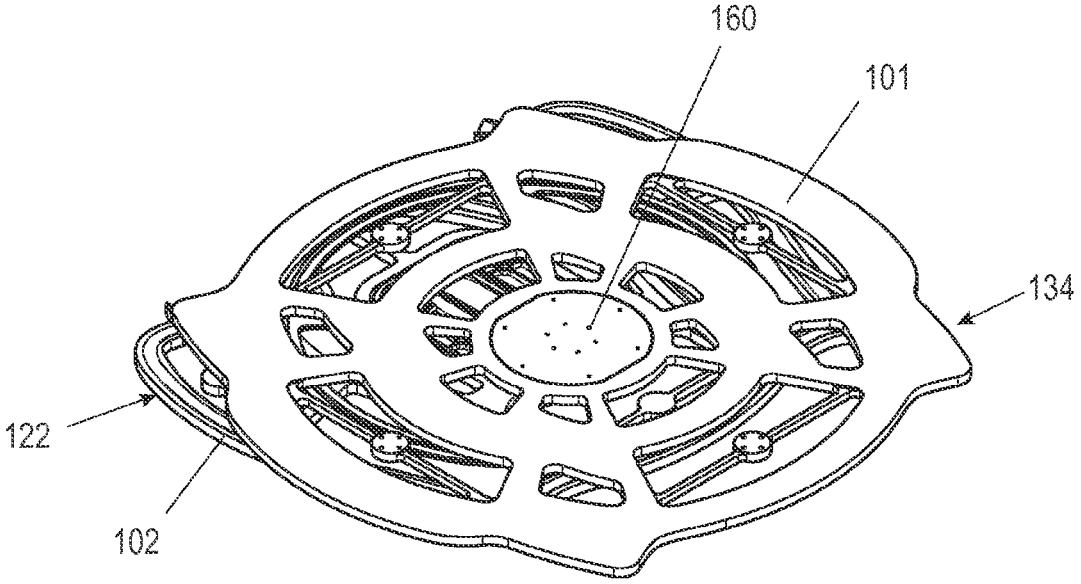
Figure 12:
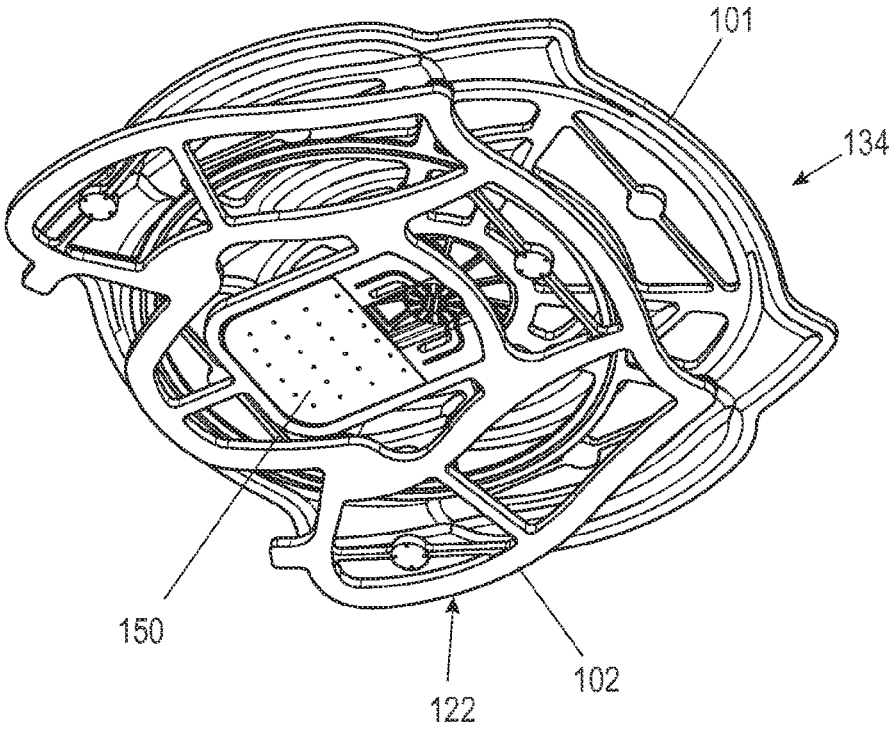
Figure 13:
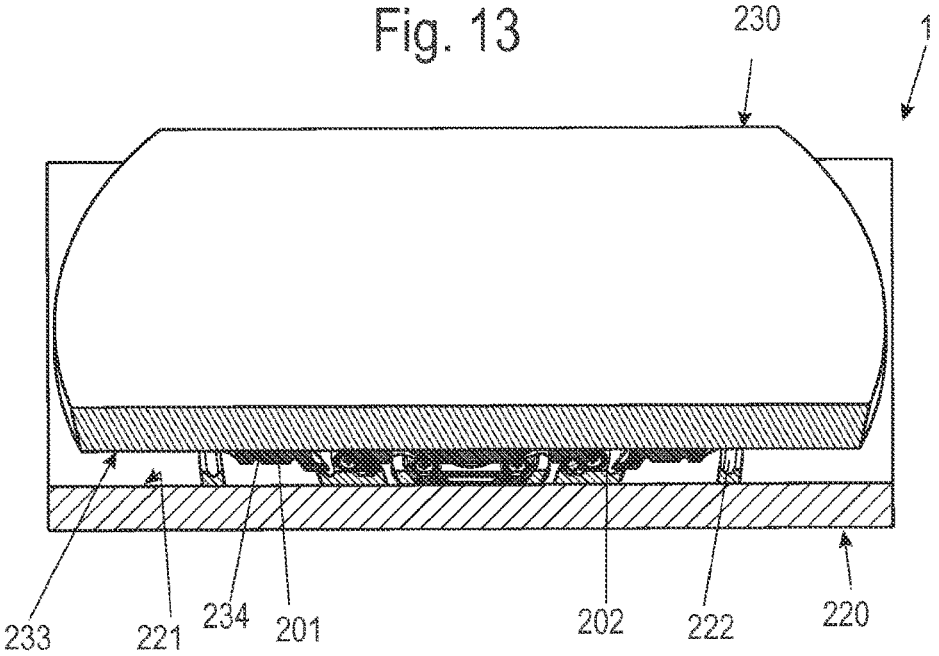
Figure 14:
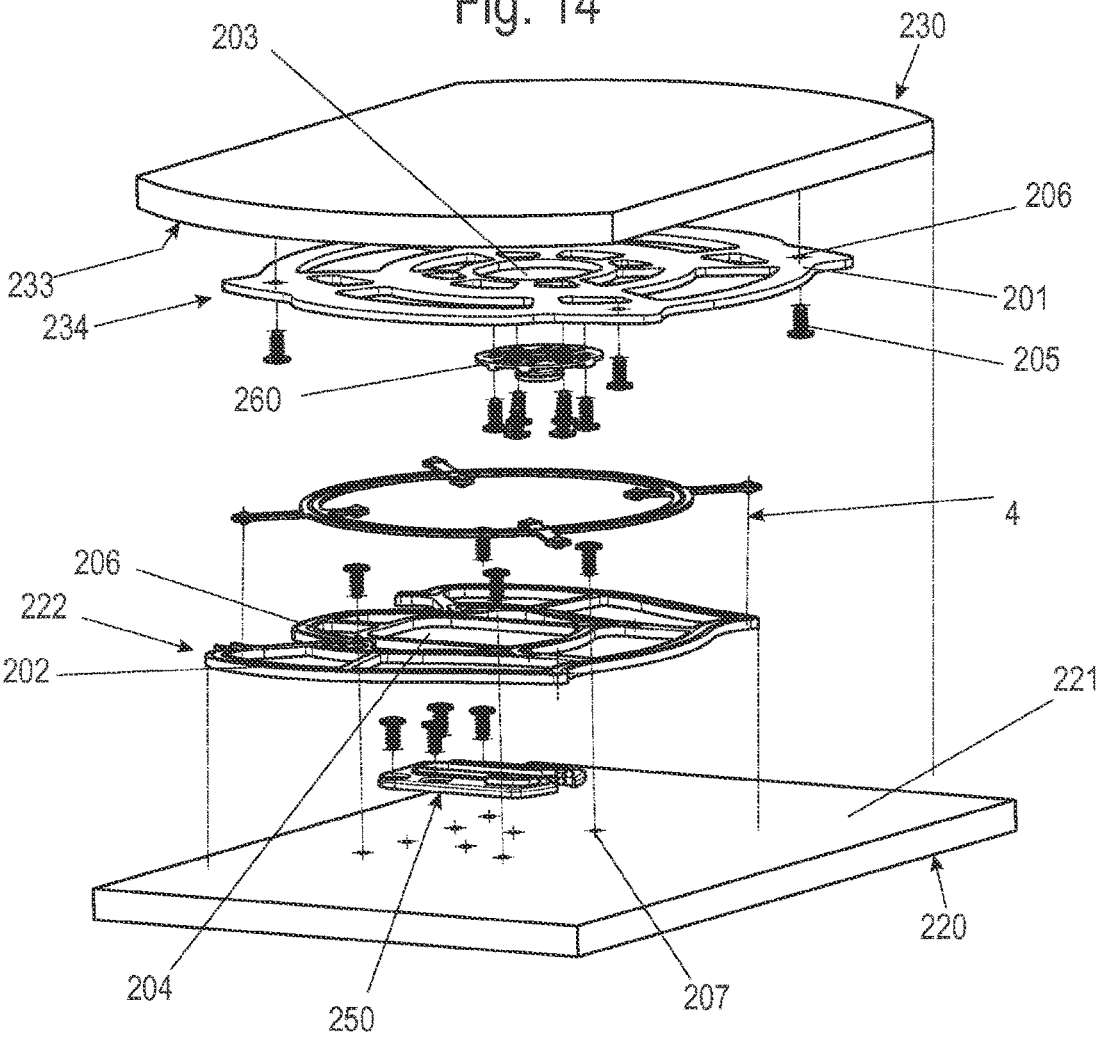
Figure 15:
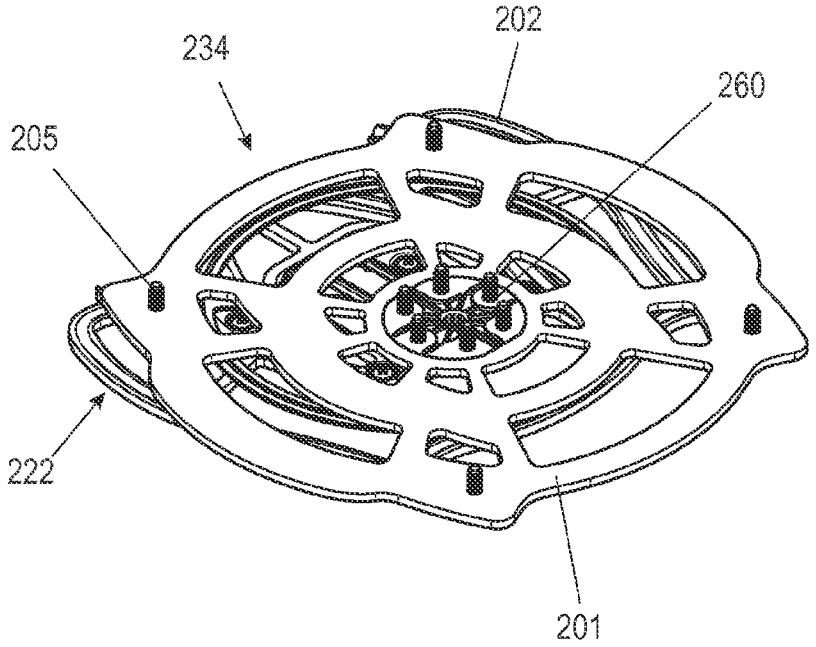
Figure 16:
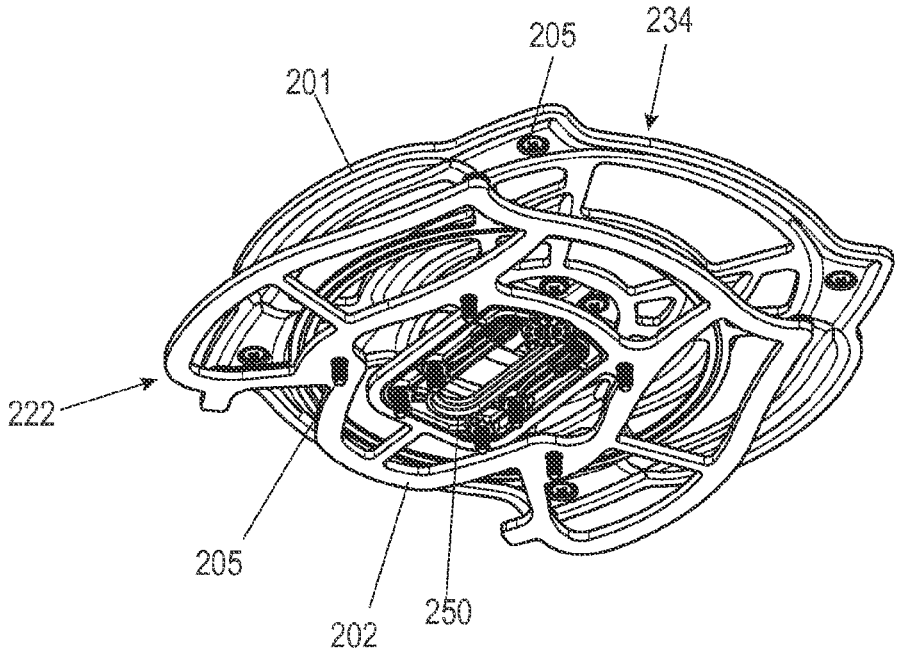
Figure 17:
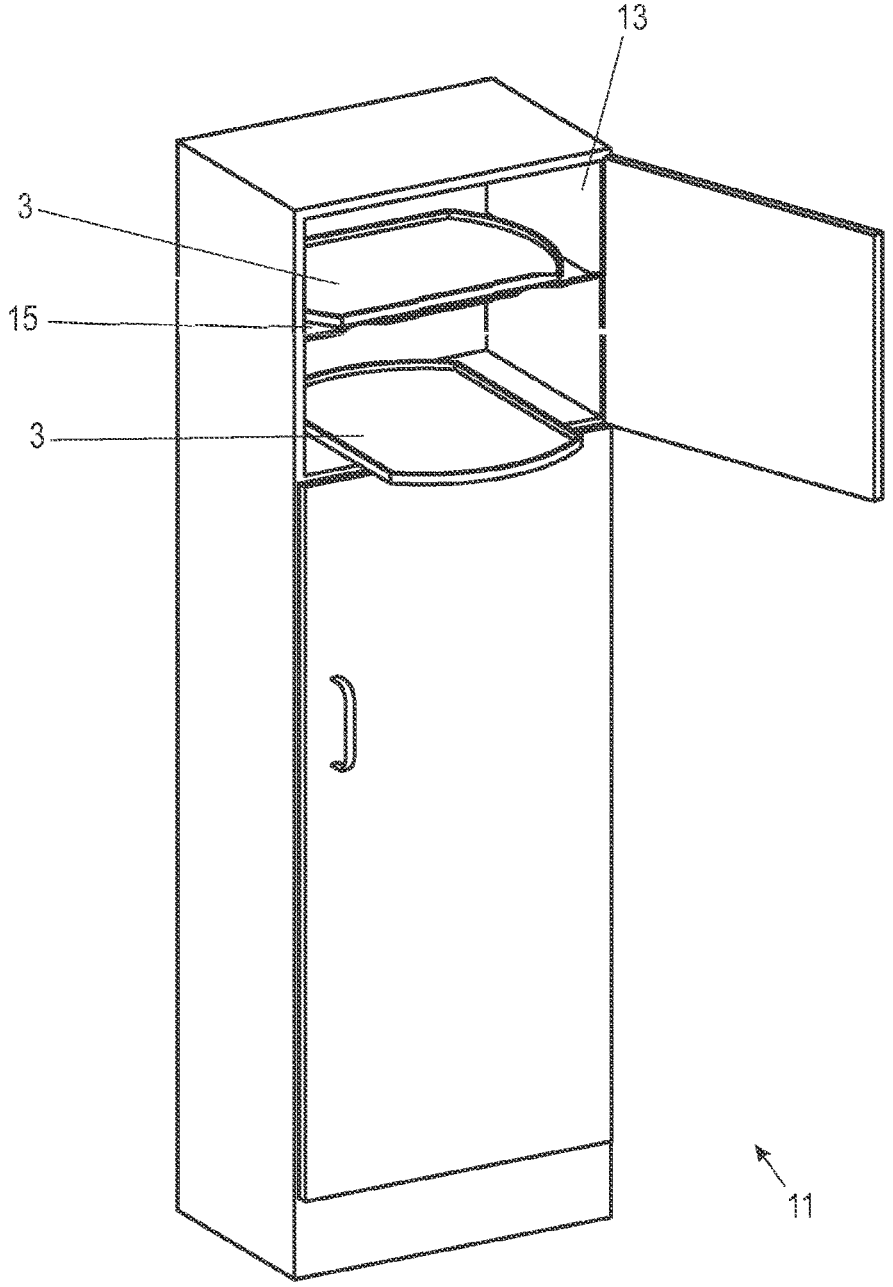
Figure 18:
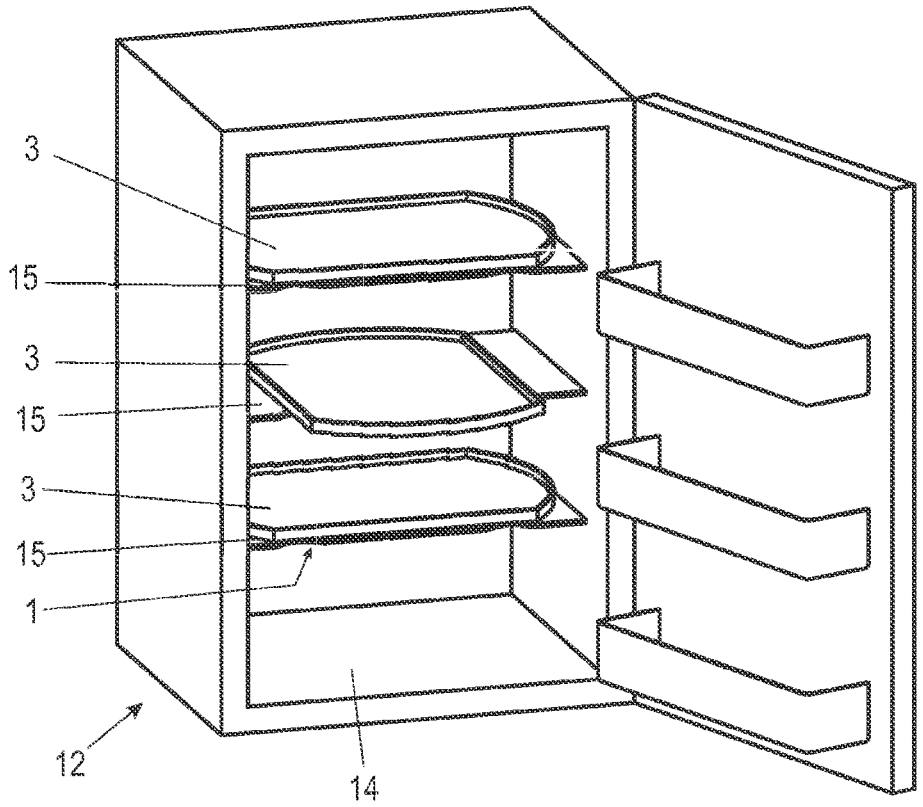

FIG. 1 shows a perspective illustration of an embodiment variant of a storage shelf base according to the invention, FIG. 2 shows a perspective exploded illustration of an embodiment variant of a storage shelf base according to the invention, FIG. 3 shows a side view of the storage shelf base shown in FIG. 2 having partially installed components;

FIGS. 4 and 5 show different perspective illustrations of the support plate of the storage shelf base, FIG. 6 shows a perspective illustration of the lower side of the storage shelf having running grooves formed thereon and a stud protruding from them, FIGS. 7 and 8 show different perspective illustrations of the guide channel embodied as a separate component, FIG. 9 shows a perspective illustration of an alternative embodiment variant of a storage shelf base according to the invention, FIG. 10 shows a perspective exploded illustration of the embodiment variant according to FIG. 9, FIGS. 11 and 12 show different perspective illustrations of the running grooves formed as separate components having roller bodies and a roller body cage mounted between them of the embodiment variant according to FIG. 9, FIG. 13 shows a perspective illustration of a further alternative embodiment variant of a storage shelf base according to the invention, FIG. 14 shows a perspective exploded illustration of the embodiment variant according to FIG. 13, FIGS. 15 and 16 show different perspective illustrations of the running grooves formed as separate components having roller bodies and a roller body cage mounted between them of the embodiment variant according to FIG. 13, FIG. 17 shows a piece of furniture having a storage shelf base according to the invention, and FIG. 18 shows a household appliance having a storage shelf base according to the invention.

DETAILED DESCRIPTION OF THE INVENTION

In the following description of the figures, terms such as top, bottom, left, right, front, rear, etc. relate exclusively to the exemplary illustration and position selected in the respective figures of the storage shelf base, the support plate, the storage shelf, the guide channel, the stud, and the like. These terms are not to be understood as restrictive, i.e., these references can change due to different operating positions or mirror-symmetrical design or the like.

An embodiment variant of a storage shelf base according to the invention is identified as a whole by the reference sign 1 in FIG. 1.

As shown in FIG. 2, the storage shelf base 1 has a support plate 2 and a simultaneously rotationally and translationally movable storage shelf 3, which is positively guided relative to the support plate 2.

The support plate 2, as shown by way of example and schematically in FIGS. 17 and 18, is fastened on a body 13, 14 of a piece of furniture 11 or household appliance 12, for example, an office, kitchen, refrigerator, or freezer cabinet.

As is furthermore shown in FIG. 2, bearing surfaces 21, 33 facing toward one another of the support plate 2 and the storage shelf 3 respectively have at least predominantly closed, circumferential running grooves 22, 34, in which roller bodies 10 are guided.

The roller bodies 10 are accommodated in a roller body cage 4 here. The roller body cage 4 has an approximately circular main body 41 in the preferred embodiment shown here, from which webs 42 extend radially inward and outward, at the ends of which roller body receptacles 43 are formed, in which the roller bodies 10 are held, so that they can be placed in a manner that is simple to effectuate between the storage shelf 3 and the support plate 2 and are simultaneously secured against falling out during operation.

The roller body receptacles 43 are shaped in such a way that the roller bodies 10 are held captively. The roller body cage 4 can also have different geometries and different arrangements of roller body receptacles 43.

The support plate 2 can be fastened removably on the body 13, 14 of the piece of furniture 11 or household appliance 12.

For this purpose, as shown in FIG. 2, two fastening regions 25 are formed on the support plate 2 for the removal fixing of the support plate 2 on the body 13, 14 or on a fixed part, for example a bottom panel, of the item of furniture 11 or household appliance 12.

It would also be conceivable to form only one such fastening region 25 on the support plate 2.

The storage shelf 3 is fixable without tools on the support plate 2. For this purpose, as shown in FIGS. 2, 3, and 6, a stud 6 protruding into a guide channel 5 of the support plate 2 is preferably arranged on the bearing surface 33 of the storage shelf 3. The stud 6 is preferably captively fixed on or in the bearing surface 33 of the storage shelf 3 or integrally formed on the storage shelf 3 for this purpose.

For vertically fixing the stud 6 in the guide channel 5, it preferably has an undercut 55, behind which a cam 62 of the stud 6 engages in the installed state of the storage shelf 3 on the support plate 2.

The guide channel 5, as can be seen well in FIGS. 2, 7, and 8, is preferably formed as a separate component, which is installable in a recess 23 of the support plate 2 adapted to the outer contour of the guide channel 5.

For fixing the guide channel 5 in the recess 23, the guide channel 5 is preferably provided with at least one catch lug 56, as shown in FIGS. 7, 8, and 5, which is lockable in a corresponding catch recess 29 of the recess 23 of the support plate 2.

As is furthermore shown in FIGS. 7 and 8, the guide channel 5 has an installation region 53 having at least one catch element 54, into which the stud 6 is easily insertable.

The installation region is formed corresponding to the outer contour of the cam 62 and the throat region 61 of the stud 6 in this case, so that during the assembly of the storage shelf base 1, after insertion of the guide channel 5 into the support plate 2, the storage shelf 3 is placed on the support plate 2, wherein the cam 62 of the stud 6 plunges into the installation region 53 of the guide channel 5.

Complete installation of the storage shelf 3 can be indicated visually or acoustically to the user by a "click" noise. No undercut is provided in the installation region 53 in this exemplary embodiment, so that both the installation and the removal of the storage shelf 3 can take place without great application of force.

After completed installation, the storage shelf 3 can move translationally along the guide channel 5 away from the installation region 53. In this case, the cam 62 of the stud 6 moves into the region vertically below the undercut 55, shown in FIG. 8. It is thus ensured that the storage shelf 3 is securely held on the support plate 2 during a movement thereof.

As shown in FIG. 8, a taper 58 is provided at one end of the guide channel 5, using which the stud 6 can be held in a position which positions the storage shelf 3 in a starting position in relation to the support plate 2.

It is thus ensured that the storage shelf 3 does not independently move inadvertently out of an initial starting position without application of force.

In the embodiment variant shown here, the taper 58 is formed by the free ends of catch elements 54 arranged opposing one another, the distance $d_2$ (width of the taper) of which is slightly less than a distance $d_1$ (width of the guide) between regions of the undercut 55 located opposite one another.

To ensure correct positioning of the guide channel 5 in the recess 23, the outer circumference 52 of the guide channel 5 is formed asymmetrically by forming a positioning piece 57. The positioning piece 57 is formed on one end of the guide channel in the embodiment variant shown here.

It is also conceivable to provide outer circumference 52 of the guide channel 5 with a positioning piece 57 at another point.

It is important that the installation of the guide channel 5 can only be carried out in a predetermined alignment, to ensure the fixing of the stud 6 and thus the storage shelf 3 in the starting position.

During the insertion of the guide channel 5 into the support plate 2, the insertion depth is limited by a circumferential undercut 51, which rests on the bearing surface 21 of the support plate 2 in the installed state.

In the above-mentioned starting position of the storage shelf 3, the stud 6 is held in the installation region 53 of the guide channel 5.

To move the storage shelf 3 out of the starting position into a loading and unloading position, an application of force to the storage shelf 3 is accordingly necessary.

The running grooves 22, 34 are shaped here in such a way that upon application of force to the storage shelf 3 in the horizontal direction, the storage shelf 3 is movable from a starting point corresponding to the orientation of the storage shelf 3 in relation to the support plate 2 shown in FIG. 1 into a loading or unloading position rotated by 180°, in which the storage shelf 3 is not only rotated by 180° but rather also translationally displaced by a distance defined by the length of the guide channel 5 to facilitate loading and unloading.

For removal of the storage shelf 3, the storage shelf 3 is raised upward with a slight application of force in the starting position shown in FIG. 1, so that the cam 62 of the stud 6 leaves the installation region 53 and thus disengages from the guide channel 5.

As shown in FIGS. 2, 3, and 6, the storage shelf 3 has multiple studs 35 on its lower side 33, using which an inclined position of the storage shelf 3 can be prevented when it is loaded on one side.

As shown in FIGS. 2 to 5, the fastening region 25 of the support plate 2 has at least one receptacle for holding a fastening element.

Multiple receptacles are shown in FIGS. 2 to 5 in this case, which enable different fastening options of the support plate 2 on a bottom panel 15 of the piece of furniture 11 or household appliance 12.

The fastening region 25 thus has at least one receptacle, which is designed as a suction cup receptacle 26 for holding a fastening element designed as a suction cup 7.

The fastening region 25 furthermore has at least one receptacle, which is designed as a bolt receptacle 24 for guiding through a fastening element designed as a threaded bolt 9.

As shown in FIG. 4 in particular, the fastening region 25 has at least one adhesive surface 27, on which an adhesive element 8 can be attached to fix the support plate 2 on a bottom panel 15 of the piece of furniture 11 or household appliance 12. The adhesive element 8 is designed here in particular as a double-sided adhesive element.

In the two embodiment variants shown in FIGS. 9 to 16, in contrast to the embodiment variant shown in FIGS. 1 to 8, the running grooves 122, 134, 222, 234 are not integrated into the bearing surfaces 21, 33 of the support plate 2 and the storage shelf 3, but rather are formed as separate running groove bodies 101, 102, 201, 202, which are fastened on the respective bearing surfaces 121, 133, 221, 233 of the support plate 120, 220 and the storage shelf 130, 230.

An embodiment variant of a storage shelf base 1 is thus shown in FIGS. 9 to 12, in which the running grooves 122, 134 are fastened by material bonding, in particular by adhesive bonding, on the support plate 120 and the storage shelf 130.

In the embodiment variant of a storage shelf base 1 shown in FIGS. 13 to 16, the running grooves 222, 234 are screwed onto the support plate 220 and the storage shelf 230.

As shown in FIGS. 11 and 12 or 15 and 16, the running groove bodies 101, 102, 201, 202 are formed planar for this purpose on their side facing toward the respective bearing surface 121, 133, 221, 233 of the support plate 120, 220 and the storage shelf 130, 230, in order to provide a sufficiently large adhesive or contact surface with the bearing surfaces 121, 133, 221, 233 of the support plate 120, 220 and the storage shelf 130, 230.

The actual running grooves 122, 134, 222, 234 are formed on the side of the running groove bodies 101, 102, 201, 202 facing away from the respective bearing surfaces 121, 133, 221, 233 of the support plate 120, 220 and the storage shelf 130, 230.

In the screwed on variant of the storage shelf base 1, as shown in FIGS. 13 to 16, additional screw receptacles 206 are provided in the running groove bodies 201, 202, through which screws 205 can be guided. The screws 205 are screwed through the screw receptacles 206 into screw boreholes 207 provided for this purpose in the support plate 220 and the storage shelf 230 to install the running groove bodies 201, 202.

As shown in FIGS. 10 and 14, in these embodiment variants, respective recesses 103, 104, 203, 204 for accommodating and positioning the guide channel 150, 250 and the stud 160, 260 are preferably formed centrally in the running groove bodies 101, 102, 201, 202.

The guide channel 150, 250 and the stud 160, 260 are also fixed by material bonding or by screwing on for the final fixing after the insertion or also clipping into the respective recesses 103, 104, 203, 204 on the bearing surfaces 121, 133, 221, 233 of the support plate 120, 220 and the storage shelf 130, 230.

The shaping and function of the running grooves 122, 134, 222, 234, the guide channel 150, 250, and the stud 160, 260 essentially correspond here to the embodiment variant described above on the basis of FIGS. 1 to 8.

In contrast to the embodiment variant described in FIGS. 1 to 8, in the embodiment variants shown in FIGS. 9 to 16, the support plate 120, 220 and the storage shelf 130, 230 are significantly simpler to manufacture, since running grooves are not formed here and openings have to be introduced for the guide channel 150, 250 and the stud 160, 260 into the support plate 120, 220 or the storage shelf 130, 230, respectively.

Due to the above-described improvements, simple installation and removal of the storage shelf base 1 and simultaneously space-saving transport are implemented. Installation and removal by the user are thus enabled, which is very advantageous in particular in the case of later installation of a storage shelf base 1 into existing pieces of furniture 11 or household appliances 12.

The following steps are carried out to install a storage shelf base:

a. attaching a support plate to a body of the piece of furniture or household appliance by means of one of the above-mentioned detachable fastening elements;

b. placing a roller body cage having roller bodies mounted therein on the support plate;

c. placing a storage shelf having a bearing surface on the roller body cage, wherein a stud protruding from the bearing surface of the storage shelf is inserted into the guide channel.

If the guide channel 5 is embodied as a separate component, insertion of the guide channel into a recess of the support plate also takes place as a further step al after step a.

In this case, step al can be performed both during the installation of the storage shelf on location at the final customer and also already at the factory, so that this step is omitted during the installation of the storage shelf on location at the final customer.

In order that the storage shelf base 1 is always correctly installed, in addition to the above-mentioned installation steps, it is also necessary for the ball cage 4 to be exactly positioned on the support plate 2. For this purpose, the support plate 2 has, in this exemplary embodiment, two positioning elements 20 on its bearing surface 21 facing toward the storage shelf 3.

However, only one or more than two positioning elements can also be provided. The ball cage 4 is laid on the support plate 2 so that the rear outer roller body receptacles 43 press against the positioning elements 20.

It is thus ensured that the roller bodies 10 move correctly in the running grooves 22, 34. The correct positioning of the storage shelf 3 on the ball cage 4 is ensured by the interaction of stud 6 and guide channel 5.

In the case of the separate formation of the running grooves 122, 134, 222, 234, as shown in FIGS. 9 to 16, the steps d. attaching a running groove body 102, 202 to the support plate 120, 220 and e. attaching a running groove body 101, 201 to the storage shelf 130, 230 also take place before step a. or between steps a. and b.

The running groove bodies 101, 102, 201, 202 are preferably adhesively bonded or screwed onto the support plate 120, 220 and the storage shelf 130, 230 to attach the running groove bodies 101, 102, 201, 202 to the support plate 120, 220 and the storage shelf 130, 230.

LIST OF REFERENCE NUMERALS

1 storage shelf base
2 support plate

20 positioning element
21 bearing surface
22 running groove
23 guide channel
24 bolt receptacle
25 fastening region
26 suction cup receptacle
27 adhesive surface
28 recess
29 catch recess
3 storage shelf
33 bearing surface
34 running groove
35 stud
4 roller body cage
41 main body
42 web
43 roller body receptacle
5 guide channel
51 undercut
52 outer circumference
53 installation region
54 catch element
55 undercut
56 catch lug
57 positioning piece
58 taper
6 stud
61 throat region
62 cam
7 suction cup
8 adhesive element
9 threaded bolt
10 roller body
11 piece of furniture
12 household appliance
13 body
14 body
15 bottom panel
101 running groove body
102 running groove body
103 recess
104 recess
120 support plate
121 bearing surface
122 running groove
130 storage shelf
133 bearing surface
134 running groove
150 guide channel
160 stud
201 running groove body
202 running groove body
203 recess
204 recess
205 screw
206 screw receptacle
207 screw borehole
220 support plate
221 bearing surface
222 running groove
230 storage shelf
233 bearing surface
234 running groove
250 guide channel
260 stud
$d_1$ width of the guide
$d_2$ width of the taper

What is claimed is:

1. A storage shelf base (1) for a piece of furniture (11) or household appliance (12), comprising;

a support plate (2, 120, 220) arranged fixed in place on a body (13, 14) of the piece of furniture (11) or household appliance (12), a simultaneously rotationally and translationally movable storage shelf (3, 130, 230) positively guided relative to the support plate (2, 120, 220), wherein bearing surfaces (21, 33, 121, 133, 221, 233) facing toward one another of the support plate (2, 120, 220) and the storage shelf (3, 130, 230) respectively have at least predominantly closed, circumferential running grooves (22, 34, 122, 134, 222, 234), in which roller bodies (10) are guided, wherein the support plate (2, 120, 220) is configured to be fastened removably on the body (13, 14) of the piece of furniture (11) or household appliance (12), wherein at least one fastening region (25) for the removable fixing of the support plate (2, 120, 220) on the body (13, 14) of the piece of furniture (11) or household appliance (12) is formed on the support plate (2, 120, 220), the storage shelf (3, 130, 230) is fixable without tools on the support plate (2, 120, 220), wherein a stud (6) protruding into a guide channel (5) of the support plate (2) is arranged on the bearing surface (33) of the storage shelf (3), and wherein the guide channel (5) at least partially has an undercut (55), behind which, in an installed state of the storage shelf (3) on the support plate (2), a cam (62) of the stud (6) engages at least during a horizontal movement of the storage shelf (3) in relation to the support plate (2).

2. The storage shelf base (1) according to claim 1, wherein the running grooves (22, 34) are integrated in the bearing surfaces (21, 33) of the support plate (2) and the storage shelf (3).

3. The storage shelf base (1) according to claim 1, wherein the running grooves (122, 134, 222, 234) are fastened on the bearing surfaces (121, 133, 221, 233) of the support plate (120, 220) and the storage shelf (130, 230).

4. The storage shelf base (1) according to claim 1, wherein the guide channel (5) has an installation region (53) having at least one catch element (54), into which the stud (6) is insertable.

5. The storage shelf base (1) according to claim 1, wherein a taper (58) is provided at one end of the guide channel (5), the taper being configured for holding the stud (6) in a position in which the storage shelf (3) is positioned in a starting position relative to the support plate (2).

6. The storage shelf base (1) according to claim 5, wherein the taper (58) is formed by free ends of catch elements (54) arranged opposing one another.

7. The storage shelf base (1) according to claim 1, wherein the guide channel (5) is designed as a separate component installable in a recess (23) of the support plate (2) adapted to an outer contour of the guide channel (5).

8. The storage shelf base (1) according to claim 7, wherein the guide channel (5) has at least one catch lug (56) on an outer circumference of the guide channel, wherein the catch lug is lockable in a catch recess (29) of the recess (23) of the support plate (2).

9. The storage shelf base (1) according to claim 7, wherein the outer circumference (52) of the guide channel (5) is formed asymmetrically having a positioning piece (57) to ensure a predetermined installation position in the recess (23) of the support plate (2).

10. The storage shelf base (1) according to claim 1, wherein the fastening region (25) has at least one receptacle for holding a fastening element.

11. The storage shelf base (1) according to claim 10, wherein the at least one receptacle is designed as a suction cup receptacle (26) for holding a fastening element designed as a suction cup (7).

12. The storage shelf base (1) according to claim 10, wherein the at least one receptacle is designed as a bolt receptacle (24) for guiding through a fastening element designed as a threaded bolt (9).

13. The storage shelf base (1) according to claim 1, wherein the fastening region (25) has at least one adhesive surface, on which an adhesive element (8) is attachable for fixing the support plate (2, 120, 220) on a bottom panel (15) of the piece of furniture (11) or household appliance (12).

14. The storage shelf base (1) according to claim 1, wherein the storage shelf base (1) has a roller body cage (4), in which the roller bodies (10) are arranged, wherein the support plate (2) has at least one positioning element (20) for the roller body cage (4).

15. A piece of furniture (11) having a body (13) having the storage shelf base (1) according to claim 1.

16. A household appliance (12) having a body (14) having the storage shelf base (1) according to claim 1.

17. A method for installing the storage shelf base (1) according to claim 1 in the body (13, 14) having the following steps:

a. attaching the support plate (2) to the body (13, 14) of the piece of furniture (11) or household appliance (12) by means of detachable fastening elements;

b. placing a roller body cage (4) having the roller bodies (10) mounted therein on the support plate (2);

c. placing the storage shelf (3) having the bearing surface (33) on the roller body cage (4), wherein the stud (6) protruding from the bearing surface (33) of the storage shelf (3) is inserted into the guide channel (5), so that the cam (62) of the stud (6) engages at least the undercut of the guide channel during the horizontal movement of the storage shelf (3) in relation to the support plate (2).

18. The method according to claim 17 having the further steps:

d. attaching a running groove body (101, 202) to the support plate (120, 220); and e. attaching a running groove body (101, 201) to the storage shelf (130, 230).

19. The method according to claim 18, wherein the attaching of the running groove body (101, 102, 201, 202) to the support plate (120, 220) and to the storage shelf (130, 230) is performed by adhesive bonding or screwing on.

* * * * *